United States Patent [19]

Schultheiss

[11] 4,072,118

[45] Feb. 7, 1978

[54] SEAM CRIMPING APPARATUS

[75] Inventor: Adrian Schultheiss, Hamilton, Ohio

[73] Assignee: Armco Steel Corporation, Middletown, Ohio

[21] Appl. No.: 750,599

[22] Filed: Dec. 15, 1976

[51] Int. Cl.[2] ..... B21D 19/00

[52] U.S. Cl. ..... 113/57; 29/243.5; 72/48; 72/DIG. 1

[58] Field of Search ..... 113/54, 57, 58; 29/243.5, 243.57, 243.58; 72/48, 122, DIG. 1

[56] References Cited

U.S. PATENT DOCUMENTS

| | | | |
|---|---|---|---|
| 2,635,332 | 4/1953 | Huntington | 113/58 X |
| 2,903,988 | 9/1959 | Engel et al. | 113/57 |
| 3,875,642 | 4/1975 | Knudson | 113/58 X |

FOREIGN PATENT DOCUMENTS

| | | | |
|---|---|---|---|
| 962,438 | 2/1975 | Canada | 113/54 R |
| 1,209,091 | 1/1966 | Germany | 113/54 |

*Primary Examiner*—Leon Gilden

*Attorney, Agent, or Firm*—Melville, Strasser, Foster & Hoffman

[57] ABSTRACT

A seam crimping apparatus for crimping standing seams of building panels.

5 Claims, 8 Drawing Figures

SEAM CRIMPING APPARATUS

BACKGROUND OF THE INVENTION

1. Field of the Invention

This invention relates in general to preengineered metal buildings and particularly to metal buildings having building panels of the standing seam type. More specifically, the invention relates to an improved apparatus for crimping and thereby sealing standing seams of adjacent side edges of two such building panels.

2. Description of the Prior Art

In an earlier filed patent application, Ser. No. 581,909, filed May 29, 1975, by Donald M. Taylor and Donald H. Ward, and entitled "INTERLOCKED CHANNEL SECTION PANELS AND CONNECTOR THEREFOR," there is shown and described unique U-shaped building panels which include a surface portion and an upstanding rib along each longitudinal edge of the surface portion. In general, the ribs are configured to mate with the corresponding rib of an adjacent panel. In practice, each of the ribs on a given panel generally includes an inverted "U" portion, and the rib along one edge of the panel, the female rib, is arranged with the "U" portion extending outwardly of the surface portion of the panel, while the "U" portion of the opposite rib, the male rib, extends inwardly being disposed above the surface portion of the panel. Accordingly, when mating ribs of adjacent panels are engaged together, the surface portions of the adjacent panels will abut one another in a single plane.

The prior art has long been concerned with developing a fully satisfactory way of securing panels similar to the aforementioned adjacent panels together, as well as with developing a tool or an apparatus therefor. As background, it will be understood that in certain cases, wherein extra rigidity is required, or wherein the seams between adjacent panels are caulked, the prior art has utilized screws through the surface portion of the panels which are parallel to the ribs of the panels. However, the possibilities of leaks in the panel system were greatly increased.

In order to avoid the use of screws, the prior art did develop miscellaneous tools which would simultaneously engage the rib portion of adjacent panels, force them into their proper relationship, and crimp to secure them in that position. However, such tools have proven to be unsatisfactory because they have been of the hand type mechanical crimper variety, which deform only a small area of the female rib, or they were machines which could not be disengaged from the rib or seam in any desired place along the length of the sheet flange or they were unable to connect building panels to one another in a fast and efficient manner and form a strong water-tight, weather resistant rib or seam.

While prior art seam forming apparatus are common, it has been found that such apparatus have some less than desirable features. For example, field experience has found that such apparatus are generally limited to the crimping of three thicknesses of metal. There are also other disadvantages, such as the apparatus hanging up on bent flanges, lacking power to squeeze sealant during cold weather, needing hand crimp at the roof edge to start and a possible safety problem when some apparatus over hang the roof edge to complete the forming of a standing seam at the roof edge. Additionally, while some apparatus can be easily removed in the middle of a standing seam, they can only be placed back on the standing seam at the roof edge. This causes delays at hang ups, ventilators, and panel end lap joints, since the operator must go to the opposite end of the standing seam to engage the apparatus and complete the deformation.

SUMMARY OF THE PRESENT INVENTION

The present invention provides seam crimping apparatus for crimping standing seams of building panels of the type having a surface portion and an upstanding rib along each longitudinal edge thereof, each rib being configured to mate with the corresponding rib of an adjacent panel and having a substantially vertical upstanding member, a substantially horizontal upper flange portion and a deformable flange hook portion extending downwardly from the upper portion toward the surface portion, to form a standing seam.

The apparatus includes a frame sized to span two parallel standing seams. The frame carries a first pair of spaced, coplanar, horizontal abutment surfaces for each standing seam adapted to overlie the horizontal flange portion of the standing seams, and a second pair of spaced, coplanar, substantially vertical abutment surfaces for each seam adapted to abut the vertical upstanding member of each seam. At least one crimping blade for each standing seam is pivotally mounted by levers carried on the frame for swinging movement between an open position and a closed position. Each crimping blade is substantially parallel to its respective seam when the apparatus is in work crimping position and lies on the opposite side of its respective seam from its respective pair of vertical abutment surfaces and parallel to the flange portion of its respective seam. Each crimping blade is backed by the abutment surfaces and is of a length sufficient to span its respective pairs of vertical and horizontal abutment surfaces. The crimping blades are shiftable between an open position, wherein they are parallel and out of contact with their respective deformable flange hook portions of the seams, and a closed position, wherein they are in contact with their respective deformable flange hook portions and have crimped the hook portions as desired. Finally, means are provided to shift the crimping blades between their open and closed positions simultaneously.

In a preferred embodiment, wheels are retractably mounted in the abutment surfaces.

In still a further preferred embodiment a shaft is carried on the frame, the shaft being parallel to the crimping blades and carrying at each end a wheel, one lever of each blade being pivotally connected by linkage means to the same point of one of the wheels, and means are provided to turn the shaft. One of the wheels may be a crank and the other of the wheels may be a crank and gear connection gear, the gear connection being associated with the means to shift the blades.

DESCRIPTION OF THE PREFERRED EMBODIMENTS

Figure 1:
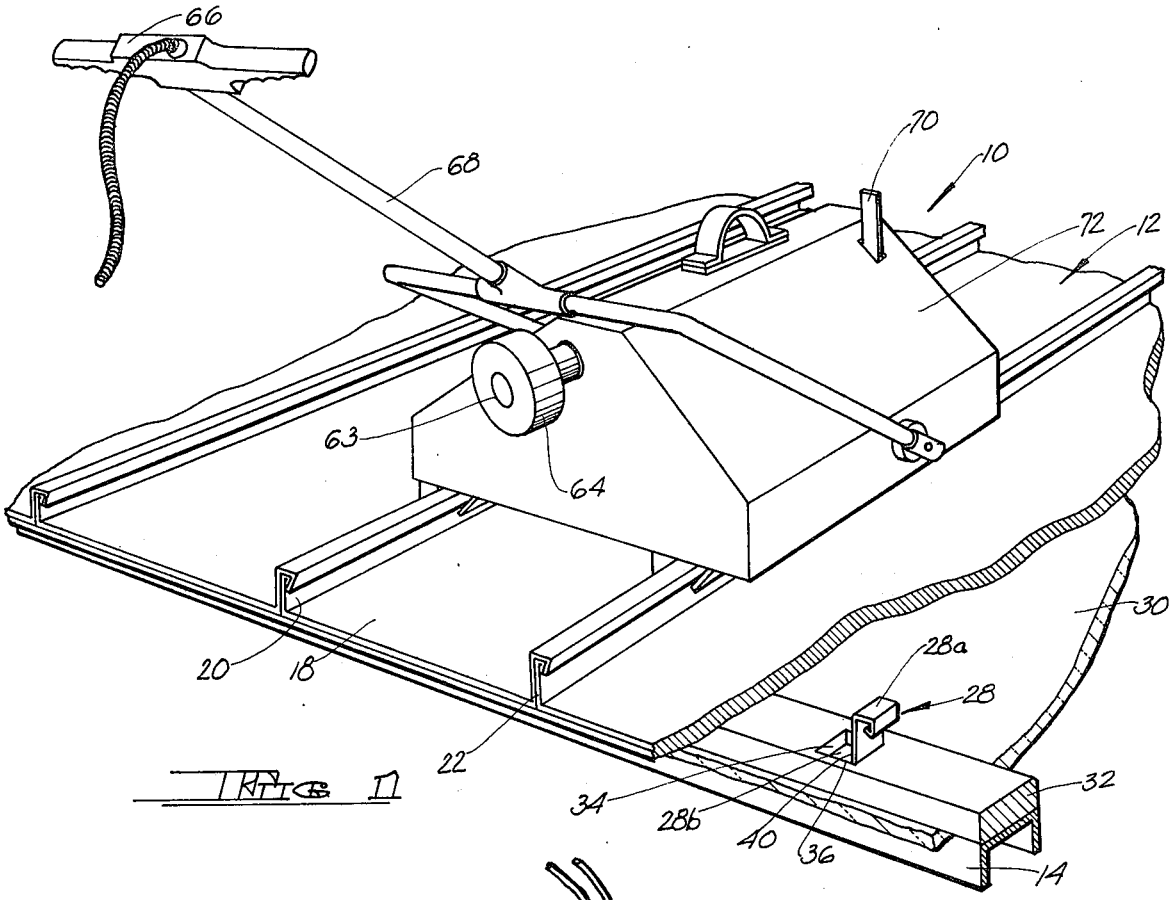
FIG. 1 is a perspective view showing fragments of two similar building panels that are being joined side by side by a seam crimping apparatus constructed in accordance with the present invention.

Referring to FIG. 1, there is shown a seam crimping apparatus 10 made in accordance with the present invention mounted in an operative position for connecting two typical building panels 12. A typical building structure may include a series of pairs of relatively stiff and rigid interlocked metal panels 12 of channel configuration and self-supporting capacity affixed to and closing the space between spaced supporting members, such as, for example, the purlin 14, and clip connectors 28, which are of a relatively shorter length than the coupled panel 12, anchor the coupled panels 12 to the purlins 14.

Each of the panels 12 is provided with a central web surface 18 and a pair of side walls 20 projecting outwardly from opposing edges of the web 18 to form inverted channel-shaped ribs along the abutting edges of the panels 12 adapted to form rib joints or standing seams 22. Each rib joint or standing seam 22 has an inverted channel shaped female member 24 secured along the edge of one panel 12 and a corresponding inverted channel-shaped male member 26 secured along the edge of an adjacent panel 12. The male and female members 26 and 24, respectively, have corresponding substantially vertical upstanding members 26*a* and 24*a* projecting from the abutting edges, corresponding substantially horizontal upper portions 26*b* and 24*b*, and deformable flange hook portions 26*c* and 24*c* extending downwardly from the upper portions 26*b* and 24*b*, respectively, toward but not contacting the web surface 18 of the panels 12.

During field assembly, the female member 24 is capable of overlying the male member 26 with the outer surface of the corresponding upstanding members 26*a*, 24*a* and upper portions 26*b* and 24*b* of the male and female members 26 and 24, respectively, adapted to mate throughout their lengths, and the deformable flange hook portions 26*c* and 24*c* of the male and female members 26 and 24, respectively, are capable of being deformed so as to conform intimately to effect continuous, positive interlocking of male and female ribs 26 and 24.

Clip connectors 28 of relatively shorter length than the coupled panels 12 are provided to anchor the coupled side walls 20 and the panels 12 provided therewith to the supporting members 14. Each clip connector 28 includes a body portion 28*a* tightly sandwiched between associated corresponding upstanding members 24*a* and 26*a*, upper portions 24*b*, 26*b* and flange hook portions 24*c*, 26*c* of the side walls 20 of the coupled panels 12, and a foot 28*b* at the end of the body portion 28*a* of the clip connector 28 anchored to a supporting member 14 and fastening the connector 28 along with the coupled panels 12 to the supporting member 14. The foot 28*b* of the clip connector 28 guarantees centering during installation and provides for movement of the joined panels 12 with respect to the plurality of spaced supporting members 14 during thermal movement of the panels.

As shown in FIG. 1, suitable insulation 30, such as blanket or roll insulation, is utilized over the supporting members 14, and rectangular insulation strips 32, of a width substantially identical to the width of the supporting members 14 and preferably of a dense non-metallic substance, such as, for example, urethane, having apertures or slots 34, are then laid on the spaced members 14. The web surfaces 18 of a run of panels 12 are then placed against the insulation 30 and 32. Thereafter, the clip connectors 28 are rotatably and shiftably positioned over the male member 26 of each panel 12, with the body portion 28*a* of the clip connector in engagement with the upstanding members 26*a*, the upper portions 26*b* and the flange hook portions 26*c* of the male members 26 of the panels 12, and the foot 28*b* of each clip connector 28 fitting into the slots 34 in the rectangular insulation strip 32. A self-drilling screw 36 is then directed through each of the apertures 40 of the clip connectors 28 into a supporting member 14 to secure the foot 28*b* of each clip connector 28 thereto. Following the setting of the screws 36, the female member 24 of a panel 12 is over laid upon the male member 26, with the body portion 28*a* of the clip connector sandwiched between the upstanding members 24*a*, 26*a* and the upper portion 24*b* and 26*b* of the female and male members 24 and 26, respectively. Hand crimping, such as at the clip connectors 28 may be done to hold the panel 12, but is normally unnecessary. It has been found that the angle of the crimp should not preferably exceed 45°. An electric crimping apparatus, such as the seam crimping apparatus 10 of the present invention, follows and completes the crimping operation along the entire length of the rib or standing seam 22, thus crimping or forming the deformable flange hook portions 24*c* and 26*c* of the female and male members 24 and 26, respectively, to conform intimately to effect continuous, positive interlocking of the female and male members 24 and 26 to form the rib or standing seam 22.

By crimping it is meant that a deformable portion or portions of adjacent panel ribs forming the standing seam 22 are deformed or reformed so as to conform intimately to effect continuous, positive interlocking of male and female ribs 26 and 24, respectively.

Figure 8:
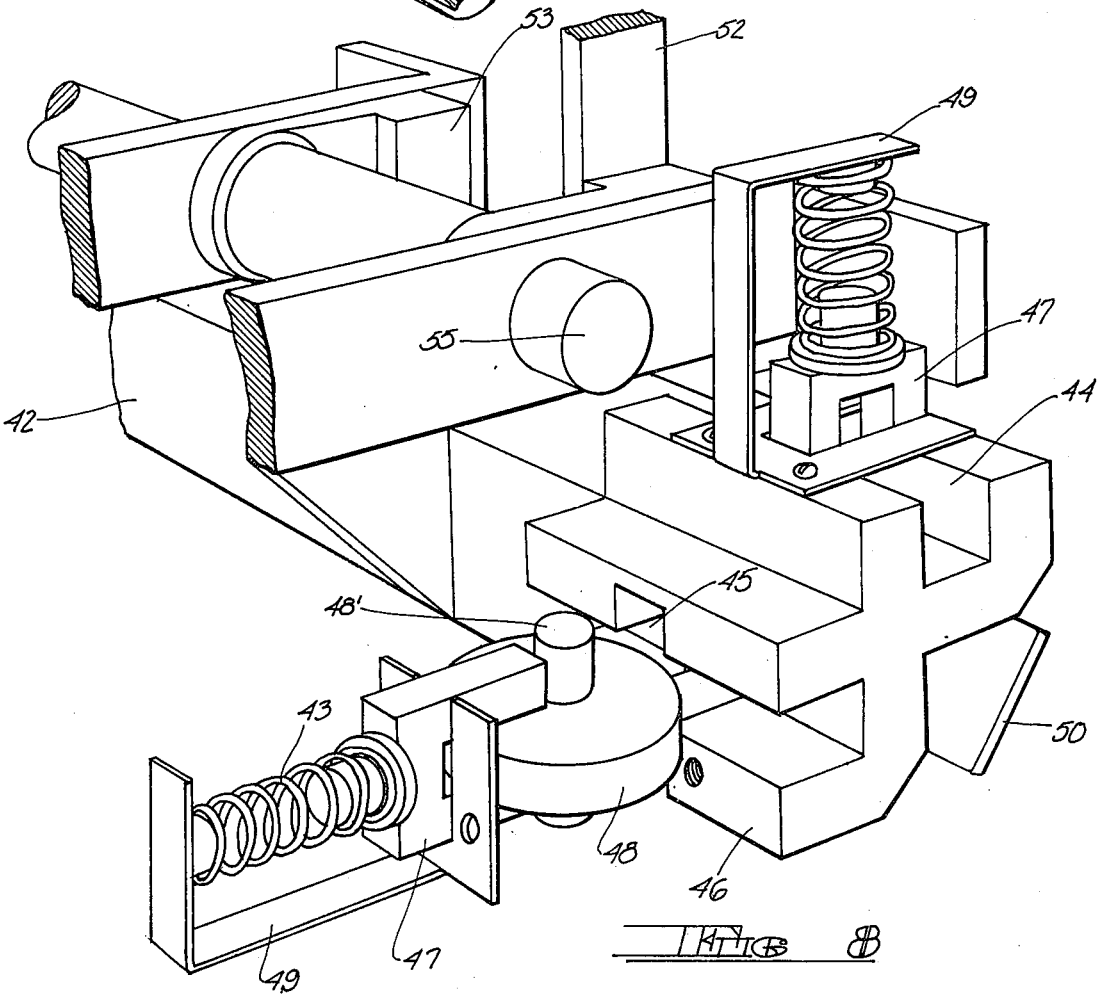
FIG. 8 is an enlarged partially exploded fragmentary perspective view showing the spring biased wheels which are retractably mounted in the abutment surfaces.

The seam crimping apparatus 10 of the present invention includes a frame 42 sized to span two parallel standing seams 22. The frame 42 carries a first pair of spaced, coplanar, horizontal abutment surfaces 44 for each standing seam 22 adapted to overlie the horizontal upper portion or flange portion 24*b*, 26*b* of the standing seams 22. The frame 42 also carries a second pair of spaced, coplanar, substantially vertical abutment surfaces 46 for each standing seam 22 adapted to abut the vertical upstanding member 24*a*, 26*a* of the seams 22. In a preferred embodiment, ajoining surfaces of the pairs of abutment surfaces 44 and 46 for each standing seam 22 may, if desired, be integral and one piece, as shown in FIG. 8.

In a preferred embodiment, spring biased wheels 48 are retractably mounted on each surface of the pairs of abutment surfaces 44 and 46. As best seen in FIG. 8, each surface of the pairs of abutment surfaces 44 and 46 is provided with a recess 45 which receives a wheel 48. A forked member 47 is held in the frame 49 and biased by the spring 43 against the axle 48′ of the wheel 48, forcing the wheel 48 into the recess 45 and against the standing seam or rib 22 being crimped.

Figure 2:
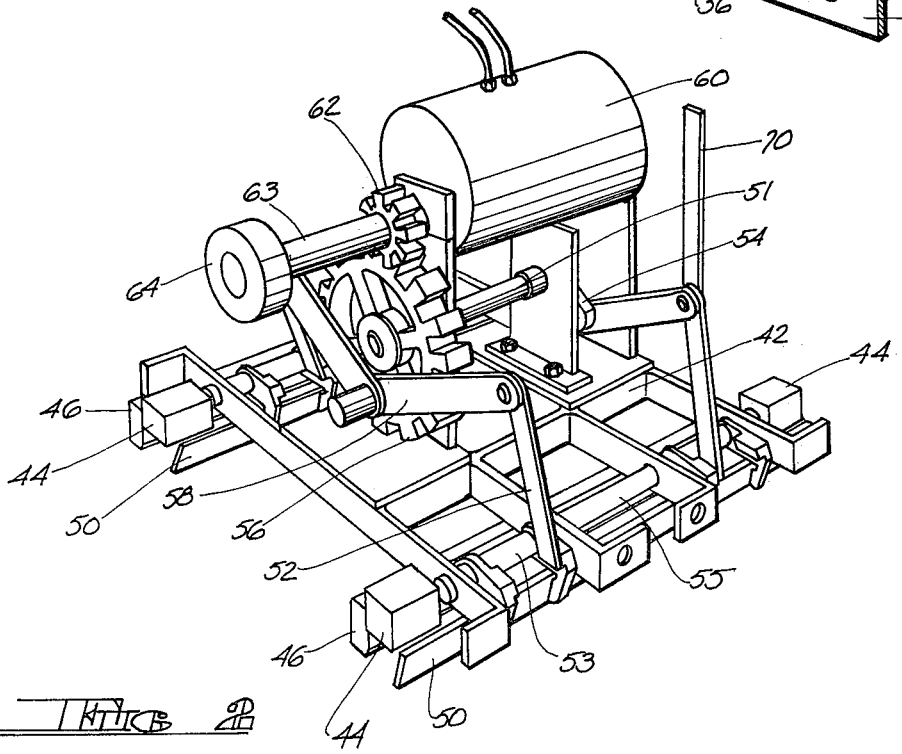
FIG. 2 is a perspective view of the seam crimping apparatus of the present invention without its protective cover.
Figure 3:
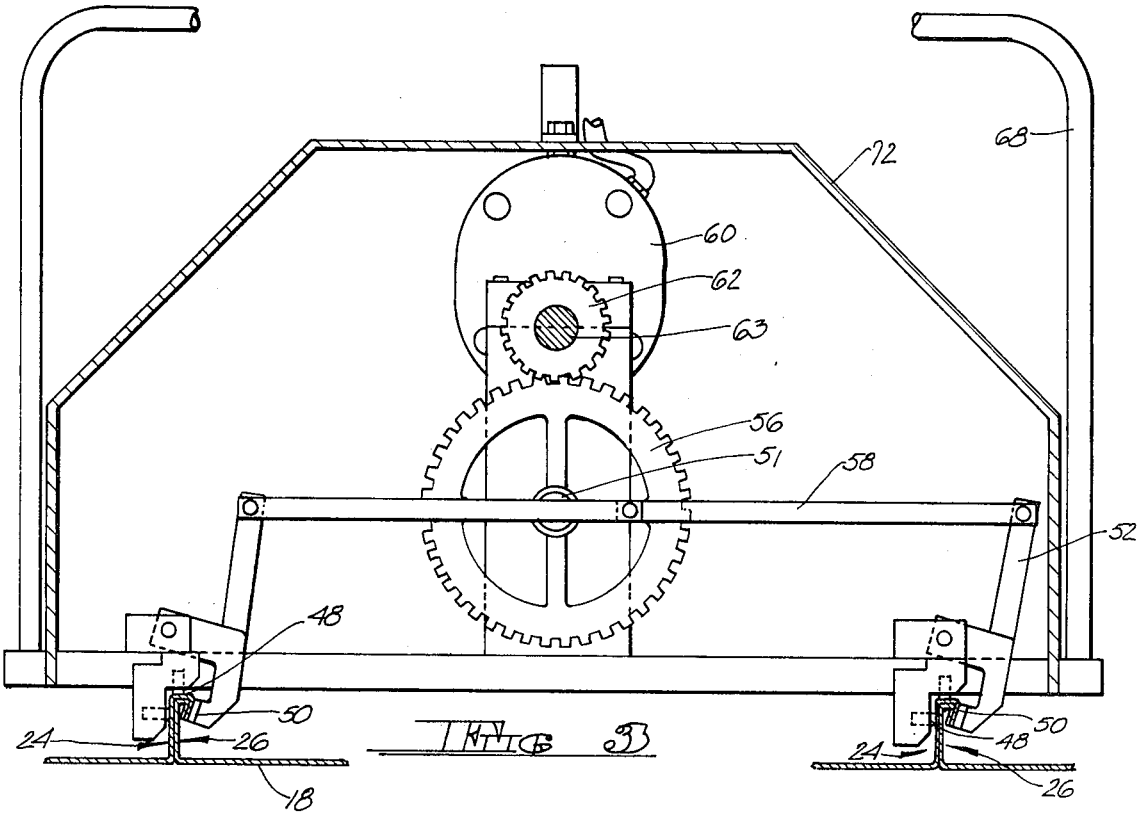
FIGS. 3 through 6 are schematic front elevation views of the seam crimping apparatus, with the cover removed, showing the operational sequence.
Figure 4:
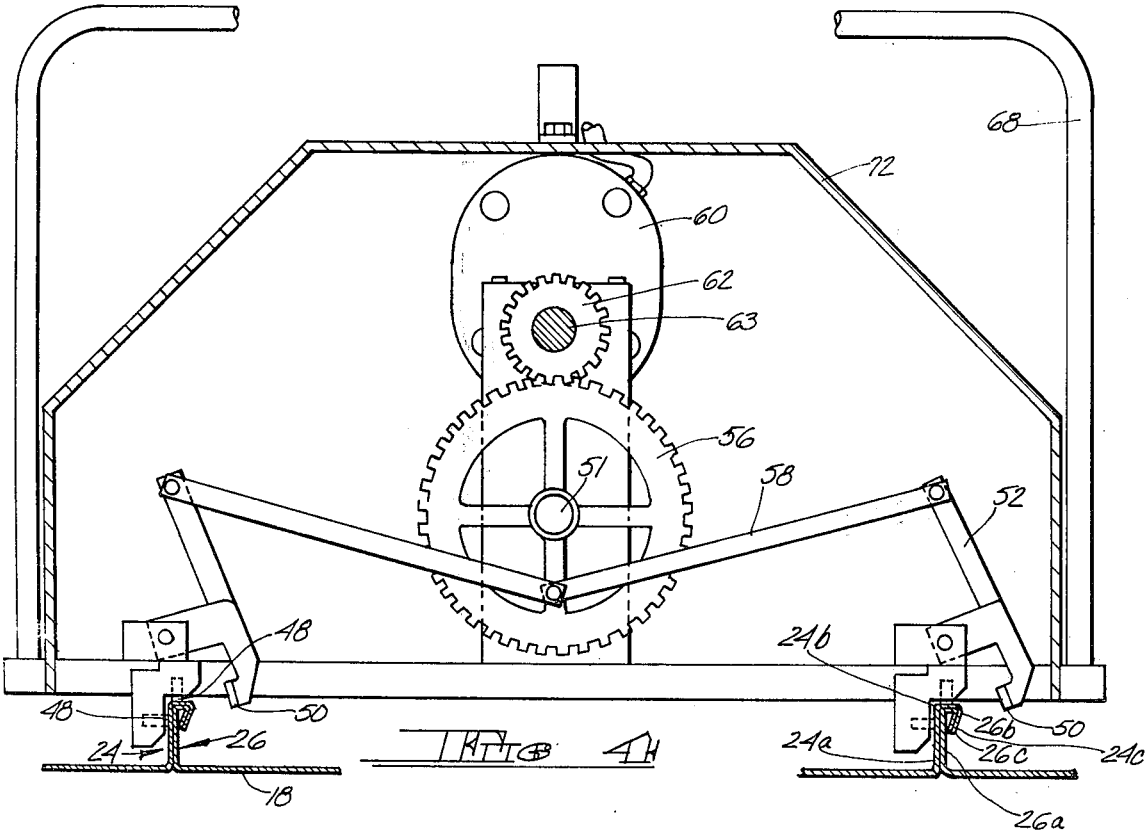
Figure 5:
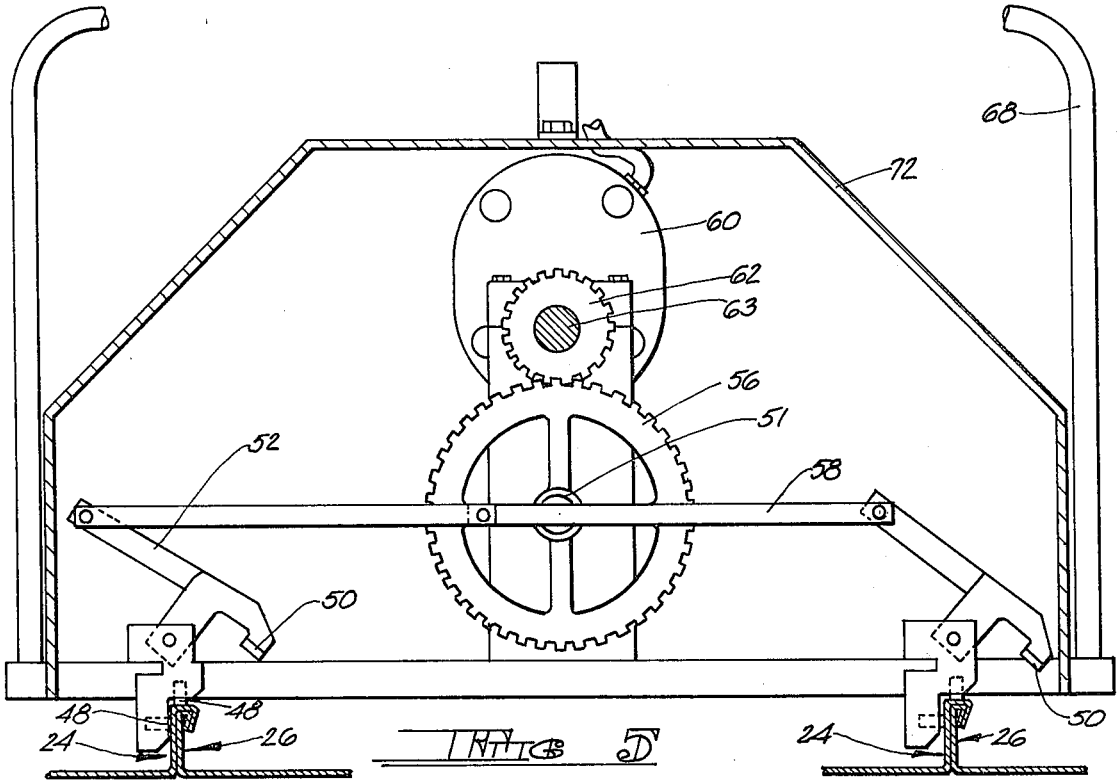
Figure 6:
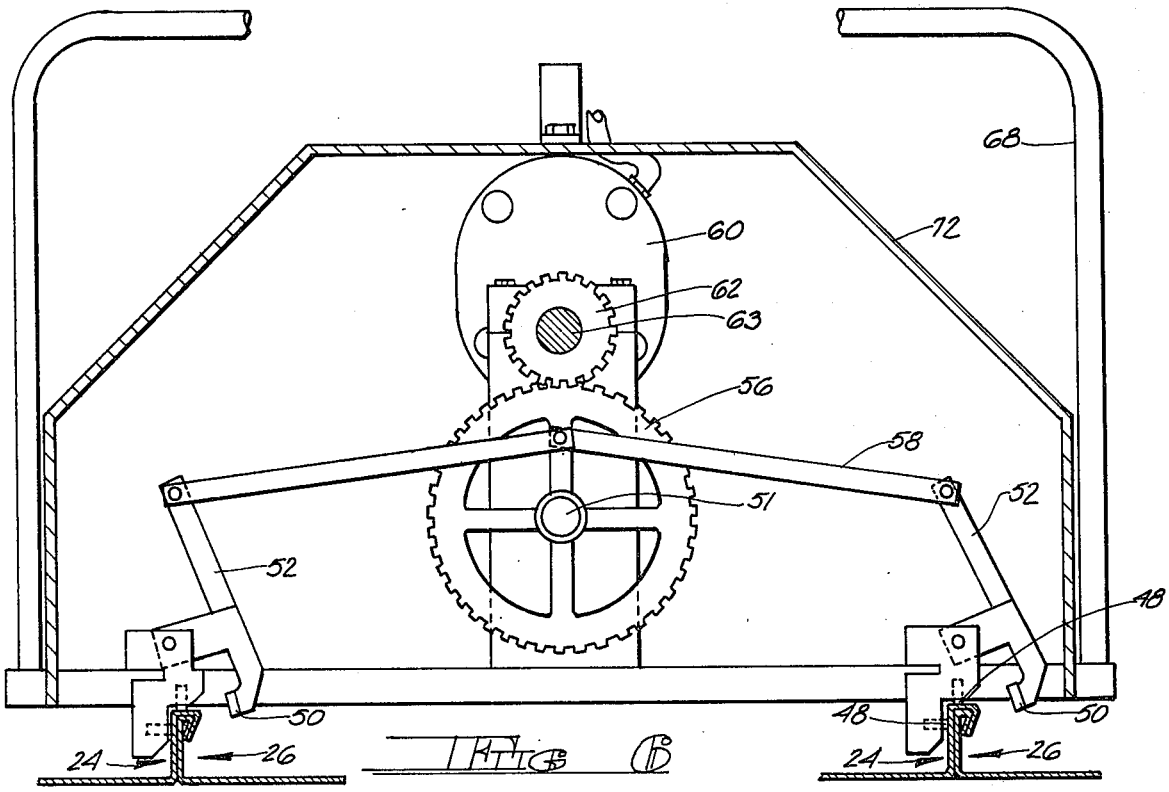
Figure 7:
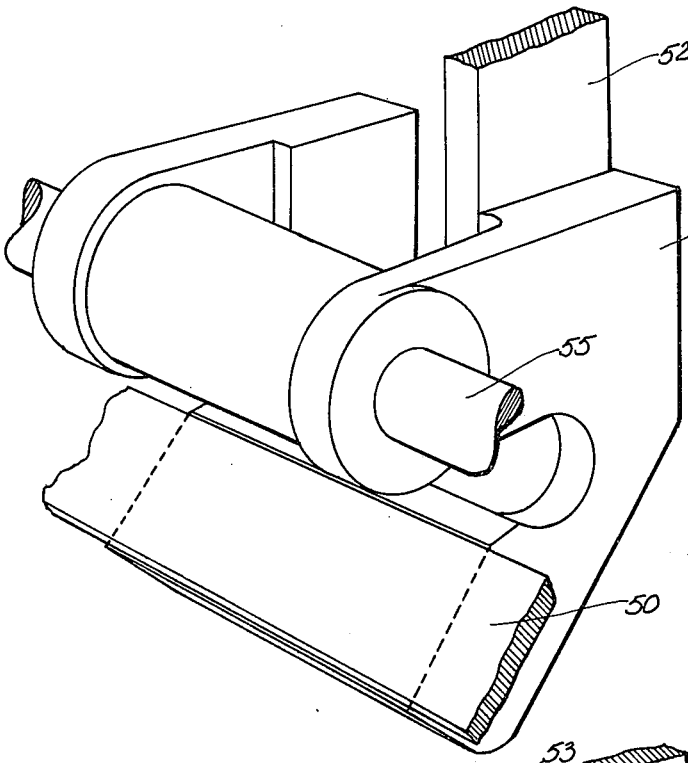
FIG. 7 is an enlarged perspective view showing a portion of the linkage means.

At least one crimping blade 50 is provided for each standing seam 22. As can best be seen in FIG. 2, the crimping blades 50 are pivotally mounted by levers 52 carried on the frame 42 for swinging movement between an open position and a closed position. In process, the levers 52 are secured to a pivoting member 53, as which in turn is pivotally mounted on a shaft 55 secured to the frame 42. The crimping blade 50 may be integral and one piece with the member 53. Each of the crimping blades 50 is substantially parallel to its respective standing seam 22 when the apparatus 10 is in work crimping position. Each crimping blade 50 lies on the opposite side of its respective seam 22 from its respective pair of vertical abutment surfaces 46 and parallel to the flange or upper portion 24*b*, 26*b* of its respective seam 22. Each crimping blade 50 is backed by the abutment surfaces 44 and 46 and is of a length sufficient to span its respective pairs of vertical and horizontal abutment surfaces 44 and 46. As will be more fully explained hereinafter, each blade 50 is shiftable between an open position, wherein it is parallel and out of contact with its respective deformable flange hook portion 24*c*, 26*c* of its respective seam 22, and a closed position, wherein it is in contact with its respective deformable flange hook portion 24*c*, 26*c* and has crimped the hook portion 24*c*, 26*c*, as desired.

Means are provided to shift the crimping blades 50 between their open and closed positions simultaneously. In a preferred embodiment, shaft 51 is carried on the frame 10. The shaft 51 is parallel to the crimping blades 50 and carries a crank 54 at one end and a crank and gear connection 56 at the other end. One lever 52 of each blade 50 is pivotally connected by linkage means 58 to the same point on one of the crank and gear connection 56 and the crank 54. Finally, means are provided to turn the shaft 51. Such means may include a motor 60 mounted on the frame. The motor 60 provides movement of a small spur gear 62 placed on the chuck end of the motor. This circular movement is transmitted to the crank and gear connection 56, which is in intimate contact therewith.

In operation, the crimper blades 50 go from a completely open to a closed (crimping) position and back to an open position during each cycle. The apparatus 10 is equiped with two blades 50 so two standing seams or ribs 22 can be crimped at one time. The blades 50 are both open and closed at the same time. The motor 60 only powers the crimping blades 50 so the apparatus must be physically pushed or pulled by the operator along the roof. The movement along the roof is not continuous. For example, when the blades 50 are in the closed position, the apparatus is momentarily locked to each of the two standing seams 22. With proper timing, the operator can proceed across the roof continuously. This is accomplished by successive short pushes by the operator with his arms to coincide with the non-closed portion of the cycle. At normal operating speeds, the duration of each cycle is 1.2 seconds (or 50 cycles per minute). The blades 50 are momemtarily locked for only a fraction of this time.

During the open position of the cycle, the apparatus 10 is lifted up and pushed away slightly from the standing seams 22 by means of the spring-loaded retractable wheels 48. At this time, the apparatus 10 is manually pushed or pulled along the panel to the next position to be crimped. The timing of the cycle speed is such that the time interval between full closed (crimping) and open (moving) position is sufficient for moving the crimper the desired increment, which is generally 16 inches.

The apparatus 10 may be engaged or disengaged at any point on the roof. An exterior hand wheel 64 is located on the shaft 63 of the small spur gear 62 for use by the operator in manually cycling the machine to an open position for removal from the standing seams 22 without actuating the electric motor 60. An "on/off" switch 66 is located on the upper reversible handle 68 for starting and stopping the motor 60. As can be seen, the motor 60 may be connected to any suitable electrical source.

As previously indicated, the wheels 48 are spring loaded. During the crimping portion of the cycle, the force of the blade 50 against the flange hook portions 24*c*, 26*c* of the standing seams 22 pushes the standing seams 22 against the upper and side supporting wheels 48. This force is sufficient to cause the wheels 48 to be retracted. Having been retracted, the abutment surfaces 44 and 46 are supported by the standing seam 22. This provides the necessary back support to allow the blades 50 to crimp the flange hook portions 24*c*, 26*c* of the seams 22. As soon as the blades 50 begin to return to the open position, the support wheels 48 again project outwardly from the abutment surfaces 44 and 46. During the open portion of the cycle, the side support wheels 48 guide the apparatus 10 along the upstanding members 24*a*, 26*a* of the standing seam 22. The springs of the upper support wheels 48 are of sufficient strength to support the weight of the apparatus so that it can easily be pushed or pulled by the operator along the upper portions 24*b*, 26*b* of the standing seams 22.

An indicator 70 may be provided protruding from the cover 72 for showing the crimping position when the apparatus 10 is turned off. The apparatus 10 can readily be removed or placed on a pair of ribs or standing seams 22. However, this must be done when the blades 50 are in the open position. It has been found that an operator with minimal experience can time the turning off of the apparatus 10 by the feel of the operation and/or sound to coinside with the open blade position. Consequently, the indicator 70 may not be required.

The apparatus 10 of the present invention will readily crimp all sizes of roofing panels without any modification. For example, the apparatus will crimp standing seams 22 of variable height or width. The angle of crimp can be readily varied by modifying the angle of the elbow of the crimping blade 50. Panels 12 of different width web portions can be accommodated by larger or smaller frames 42 and linkages 58. Different style standing seams 22 may also be crimped by using a crimping blade 50 which fits the contour of such a standing seam.

It has been found that the apparatus 10 of the present invention may be successfully operated with a $1\frac{1}{4}$ HP drill motor. Field experience shows that the apparatus 10 will average 8300 feet per hour, i.e., 135 linear feet per minute or 1.57 mile per hour (two ribs taken at a time).

The apparatus of the present invention crimps standing seams 22 of five thicknesses very easily. The apparatus 10 may be removed in the middle of a rib or standing seam 22 and may be placed back on the rib or standing seam at any location. Accordingly, delays are not encountered at hang ups, ventilators, and panel end lap joints, since it is unnecessary for the operator to go to the opposite end of the standing seams 22 to engage the apparatus. The apparatus 10 of the present invention causes the sealant on the underside of the upper portion 24*b* to flow evenly during the crimping operation and no problem results during changes of viscosity during cold weather. The apparatus 10 of the present invention does not over-hang the roof edge, nor is an initial hand crimp required to start.

It should be noted that there are no critical strength or dimensional requirements regarding the support wheels 48 motor 60 or frame 42. The frame 42, spur gears 56 and 62, and blades 50 are preferrably aluminum allow castings so as to obtain high strength-low weight. However, they could be cast iron or steel. The only requirement for the springs used with the wheels 48 is that they be of sufficient strength to support the weight of the apparatus 10 to prevent the frame 42 from touching the standing seams 22 and scratching the coating on the panels 12.

Although the present invention has been described with a certain degree of particularity, it is understood that the present disclosure has been made by way of example and that changes and details of structure may be made without departing from the spirit thereof.

I claim:

1. A seam crimping apparatus for crimping standing seams of roofing panels of the type having a surface portion and an upstanding rib along each longitudinal edge thereof, each rib being configured to mate with the corresponding rib of an adjacent panel and having a substantially vertical upstanding member, a substantially horizontal upper flange portion and a deformable flange hook portion extending downwardly from the upper portion toward the surface portion, to form a standing seam, which comprises:

a. a frame sized to span two parallel standing seams, said frame carrying a first pair of spaced, coplanar, horizontal abutment surfaces for each standing seam adapted to overlie said horizontal flange portion of said standing seams and a second pair of spaced, coplanar, substantially vertical abutment surfaces for each seam adapted to abut the vertical upstanding member of said seams, and wheels retractably mounted in at least said horizontal abutment surfaces to guide and support said seam crimping apparatus along the standing seams;

b. at least one crimping blade for each standing seam pivotally mounted and connected to levers carried on said frame for swinging movement between an open position and a closed position, each said crimping blade being substantially parallel to its respective seam when said apparatus is in work crimping position and lying on the opposite side of its respective seam from its respective pair of vertical abutment surfaces and parallel to the flange portion of its respective seam, each said crimping blade being backed by said abutment surfaces and being of a length sufficient to span its respective pairs of vertical and horizontal abutment surfaces, each said blade being shiftable between an open position wherein it is parallel and out of contact with its respective deformable flange hook portion of said seam, and a closed position wherein it is in contact with its respective deformable flange hood portion and has crimped said hook portion as desired; and c. means to shift said crimping blades between their open and closed positions simultaneously.

2. The seam crimping apparatus according to claim 1, wherein each surface of said pairs of abutment surfaces is provided with a recess which receives said wheel, and wherein each said wheel is spring biased into said recess and against the standing seam being crimped.

3. The seam crimping apparatus according to claim 2, wherein adjoining surfaces of said pairs of abutment surfaces for each standing seam are integral and one piece.

4. The seam crimping apparatus according to claim 1, wherein a shaft is carried on said frame, said shaft being parallel to said crimping blades and carrying at each end a wheel, one lever of each said blade being pivotally connected by linkage means to the same point of one of said wheels, and means to turn said shaft.

5. The seam crimping apparatus according to claim 4, wherein one of said wheels is a crank and the other of said wheels is a crank and gear connection, said gear being associated with said means to shift said blades.

* * * * *